US009091103B2

(12) United States Patent
Buzz, III

(10) Patent No.: US 9,091,103 B2
(45) Date of Patent: Jul. 28, 2015

(54) SLIDING GLASS DOOR SAFETY LATCH

(71) Applicant: Frank Herman Buzz, III, Port ST Lucie, FL (US)

(72) Inventor: Frank Herman Buzz, III, Port ST Lucie, FL (US)

( * ) Notice: Subject to any disclaimer, the term of this patent is extended or adjusted under 35 U.S.C. 154(b) by 263 days.

(21) Appl. No.: 13/847,185

(22) Filed: Mar. 19, 2013

(65) Prior Publication Data

US 2014/0117680 A1 May 1, 2014

Related U.S. Application Data

(60) Provisional application No. 61/613,809, filed on Mar. 21, 2012.

(51) Int. Cl.

| | |
|---|---|
| ***E05C 1/02*** | (2006.01) |
| ***E05C 5/00*** | (2006.01) |
| ***E05C 1/08*** | (2006.01) |
| ***E05C 1/16*** | (2006.01) |
| ***E05B 65/08*** | (2006.01) |
| *E05C 1/00* | (2006.01) |

(52) U.S. Cl.

CPC . *E05C 5/00* (2013.01); *E05B 65/08* (2013.01); *E05B 65/087* (2013.01); *E05C 1/00* (2013.01); *E05C 1/085* (2013.01); *E05C 1/166* (2013.01); *Y10T 292/0999* (2015.04)

(58) Field of Classification Search

CPC ..... E05C 1/00; E05C 1/004; E05C 1/08; E05C 1/085; E05C 1/12; E05C 1/16; E05C 1/166; E05B 65/08; E05B 65/0864; E05B 65/087

USPC ..... 292/95, 96, 137, 138, 163, 177, 292/DIG. 25, DIG. 37, DIG. 46; 70/95–100

See application file for complete search history.

(56) References Cited

U.S. PATENT DOCUMENTS

| | | | | |
|---|---|---|---|---|
| 405,678 | A | 6/1889 | Rand | |
| 1,205,061 | A * | 11/1916 | Thull | 292/175 |
| 1,252,454 | A * | 1/1918 | Le Beau | 292/192 |
| 2,405,240 | A * | 8/1946 | Shearer et al. | 70/100 |
| 2,736,185 | A | 6/1953 | Collar | |
| 2,668,319 | A * | 2/1954 | Keys et al. | 292/336.3 |

(Continued)

FOREIGN PATENT DOCUMENTS

| | | |
|---|---|---|
| EP | 1936077 | 6/2006 |
| EP | 1907655 | 4/2008 |

(Continued)

*Primary Examiner* — Carlos Lugo

(74) *Attorney, Agent, or Firm* — PEI; Michael T. Perkins

(57) ABSTRACT

A closure securing mechanism implementing a latching without further operator interaction mechanism for sliding doors when completely slid closed. The closure securing mechanism implements the automatic latching function through industry standard compatible devices or modifications to existing sliding door latching hardware. When the closure securing mechanism is installed on a sliding door the latching mechanism will be positively secured anytime the door is fully slid closed. The mechanism can be opened from inside and outside with standard pull handles with sliding locks. The sliding lock portion has a spring of specific tension, specific body and total length in tension so whenever the door is slid closed and the keeper latch is angled to engage and hold a latching arm inhibiting opening of the door until the tension of the spring is overcome by an operator sliding the sliding lock against the spring in tension.

14 Claims, 3 Drawing Sheets

(56) References Cited

U.S. PATENT DOCUMENTS

| | | | | | |
|---|---|---|---|---|---|
| 2,844,020 | A | * | 7/1958 | Chittum et al. | 70/97 |
| 3,012,430 | A | * | 12/1961 | Spork | 70/99 |
| 3,173,716 | A | * | 3/1965 | Silvers | 292/147 |
| 3,216,229 | A | * | 11/1965 | Moncada | 70/100 |
| 3,347,581 | A | * | 10/1967 | Hann | 292/147 |
| 3,390,557 | A | * | 7/1968 | Erickson et al. | 70/97 |
| 3,615,114 | A | | 10/1969 | Harris | |
| 3,779,588 | A | | 12/1973 | Raymon | |
| 3,918,750 | A | * | 11/1975 | Okamoto | 292/106 |
| 4,024,739 | A | | 5/1977 | Kaufman | |
| 4,102,545 | A | | 7/1978 | Jay | |
| 4,103,946 | A | * | 8/1978 | Tipler | 292/114 |
| 4,141,610 | A | * | 2/1979 | Ando | 312/114 |
| 4,302,037 | A | * | 11/1981 | Nunez | 292/128 |
| 4,480,862 | A | * | 11/1984 | Fleming | 292/162 |
| 4,607,510 | A | * | 8/1986 | Shanaan et al. | 70/95 |
| 4,790,157 | A | * | 12/1988 | Lin | 70/95 |
| 4,798,407 | A | | 1/1989 | Miller | |
| 5,092,144 | A | * | 3/1992 | Fleming et al. | 70/95 |
| 5,228,733 | A | | 7/1993 | Winters | |
| 5,983,570 | A | | 11/1999 | Brown | |
| 6,000,735 | A | | 12/1999 | Jourdenais | |
| 6,019,400 | A | * | 2/2000 | Prevot et al. | 292/145 |
| 6,050,617 | A | * | 4/2000 | Prevot et al. | 292/140 |
| 6,247,341 | B1 | * | 6/2001 | Prevot et al. | 70/101 |
| 6,327,879 | B1 | | 12/2001 | Malsom | |
| 6,357,808 | B1 | * | 3/2002 | Supernat | 292/348 |
| 6,709,031 | B1 | | 3/2004 | Michael | |
| 6,874,198 | B2 | | 4/2005 | Renaud | |
| 7,178,839 | B2 | | 2/2007 | Tsai | |
| 7,373,794 | B1 | * | 5/2008 | DePass | 70/99 |
| 7,695,030 | B2 | * | 4/2010 | Balbo Di Vinadio | 292/150 |
| 7,731,252 | B1 | | 6/2010 | Stewart | |
| 7,942,027 | B1 | | 5/2011 | Cassini | |
| 2006/0082166 | A1 | * | 4/2006 | Lawrence | 292/337 |
| 2012/0272576 | A1 | | 11/2012 | Van Tassell, III et al. | |

FOREIGN PATENT DOCUMENTS

| | | | | | |
|---|---|---|---|---|---|
| EP | 1936077 | A1 | * | 6/2008 | E05B 65/08 |
| EP | 2302151 | | | 3/2010 | |
| EP | 2302151 | A1 | * | 3/2011 | |
| FR | 2752866 | A1 | * | 3/1998 | |
| GB | 870421 | | * | 6/1961 | |
| GB | 1396876 | A | * | 6/1975 | |
| GB | 2008183 | A | * | 5/1979 | |

* cited by examiner

SLIDING GLASS DOOR SAFETY LATCH

FEDERALLY SPONSORED RESEARCH

No

SEQUENCE LISTING OR PROGRAM

No

BACKGROUND

1. Technical Field of Invention 70/91

This invention relates to a door lock and more particularly to such a door lock for a sliding glass door with automatic latching capability.

2. Background of the Invention

Sliding doors offer many benefits to building functionality. This is particularly true when the sliding doors are constructed of mostly glass. Glass sliding doors are quite popular as they let in maximum amounts of light yet offer decent security and safety. Latching of sliding doors has been difficult to design given the conflicting priorities presented. A few of the priorities are: egress/ingress, security, safety, and ease of use. Everyone would like to have a door that was easy to open from the inside, easy to secure for the outside, and impervious to vandals. Unfortunately, many of these functions are at odds when designers try to satisfy all priorities. Currently, the standard for sliding glass doors is a pull handle on both inside and outside, a lock engage-able and release-able only from the inside, and a inhibit lever to prohibit releasing the lock when the inhibit lever is engaged without disengaging the inhibit lever. Additionally, keyed locks are also typically used to allow access from the outside when the inhibit or night latch is engaged. A safety problem has been identified that can cause undue risks to young children, pets, or compromised adults. The safety problem occurs typically when the sliding door is slid closed the lock may or may not have been set. It is easy for most functional adults to remember to close the door when required (when a pool or similar hazard is beyond the door). It is also easy to check from a distance if the door is slid closed but the lock is impossible to verify (locked/unlocked) from any distance and most often is only checked by a physical pull on the door handle. Some recent designs offer auto closing and independent auto latching however these are expensive and difficult to operate and may cause a fire hazard to shorter individuals unable to operate the raised release during an emergency. Previous attempts to latch sliding door mechanisms suffered from internal mechanism binding and an inability to operate from both inside and outside. What is needed is an auto-latching mechanism for sliding door hardware without additional operational requirements.

SUMMARY OF THE INVENTION

The intention of this invention is to implement a closure securing mechanism implementing latching of sliding doors when completely slid closed without any further operator interaction while avoiding increased operational complexity for operators. The closure securing mechanism implements automatic latching function through industry standard compatible devices or modifications to existing sliding door latching hardware. When the closure securing mechanism is installed on a sliding door the latching mechanism will be positively secured anytime the door is fully slid closed. The mechanism can be opened from inside and outside with standard pull handles with sliding locks through addition of a dowel or pin connecting inside and outside portions of locking mechanisms. The sliding lock portion has a spring in tension so whenever the door is slid closed and the keeper latch is engaged the hold latch will inhibit opening of the door until the tension of the spring is overcome by an operator sliding the sliding lock against the spring in tension. The spring is of specific body and total length to fit within existing mechanisms and operate without binding on complimentary mechanism portions. The sliding lock can be operated from inside or outside. Normal ingress/egress operation of a typical sliding door mechanism from inside or outside without a key or additional operations is provided for. Night/safety lock functions are fully compatible with this automatic latching mechanism. Key/locking functions to further secure positive locking are easily incorporated to this automatic latching mechanism. Remote control, sensors, solenoids, relays, closure devices or other operational enhancement equipment are compatible and intended to be included with this design.

DETAILED DESCRIPTION OF THE DRAWINGS

Figure 1A:
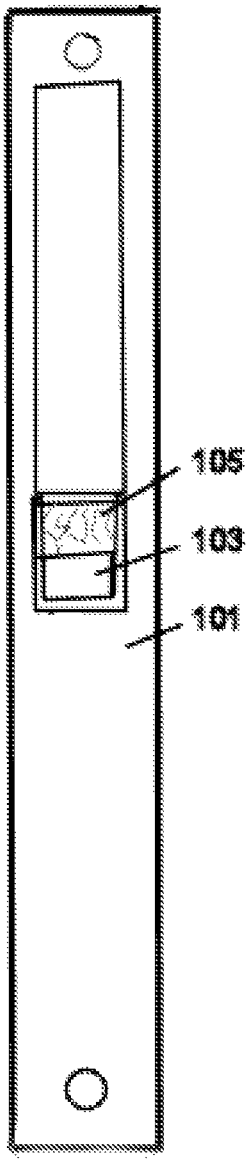
FIG. 1*a* shows a representation of a modified typical sliding door locking mechanism as viewed from the outside of a building installation.

FIG. 1*a* shows a representation of a modified typical sliding door locking mechanism 101 outside handle portion as viewed from the outside of a building installation. The mechanism 101 shown features external operation and will mount on the outside on the final edge of a typical sliding door. The recessed portion 103 allows an operator on the outside to depress the actuator 105 and open the door when slid closed without being latched.

Figure 1B:
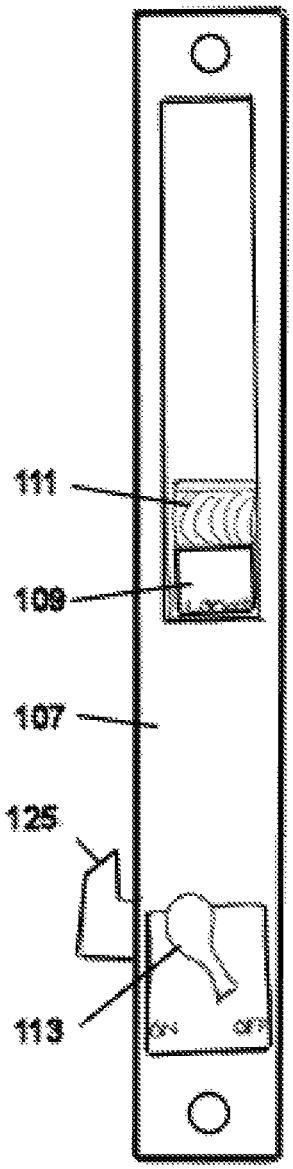
FIG. 1*b* shows a representation of a typical sliding door locking mechanism as viewed from the inside of a building installation.

FIG. 1*b* shows a representation of a typical sliding door locking mechanism 107 outside handle portion as viewed from the inside of a building installation. The mechanism 107 shown will mount on the inside on the final edge of a typical sliding door. The recessed portion 109 allows an operator on the inside to depress an actuator 111 and open the door when latched. Also on the inside mechanism 107 is a night safety latch 113 that allows the door to be night latched by engaging latching arm 125 and not open from the outside. The mechanism 107 will open when the sliding door is fully slid closed and engage the latch 113 with no operator intervention. The mechanism 107 requires the inside operator to physically operate the latch 113 to secure against opening either from inside or outside without the latch 113 being disengaged. The latch 113 will not engage unless the door is fully slid closed.

Figures 2A, 2B, 2C, 2D:
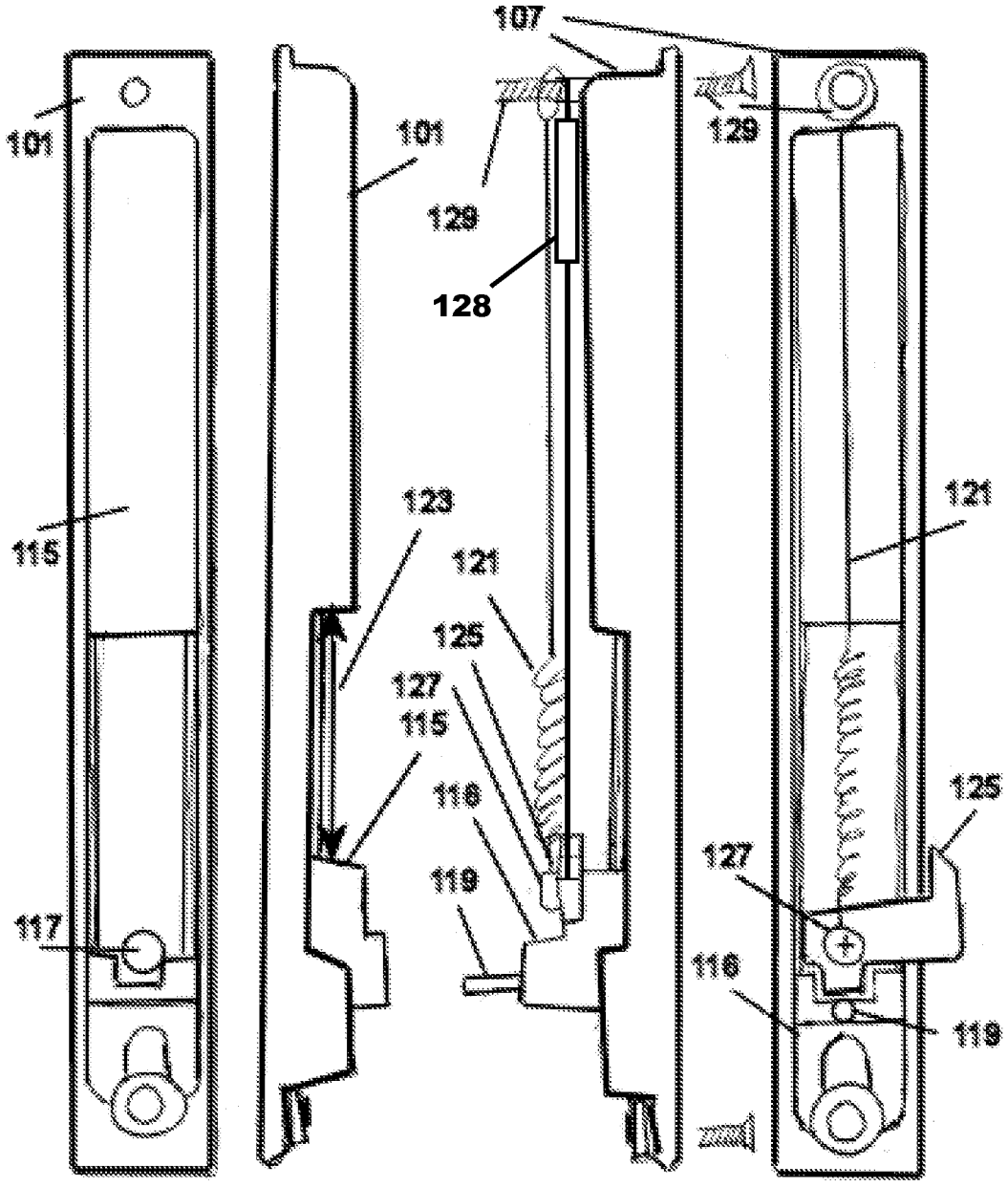
FIG. 2*a* shows a representation of a typical sliding door locking mechanism outside handle portion as viewed from the back of the handle or from inside of the door.
FIG. 2*b* shows a representation of a typical sliding door locking mechanism outside handle portion as viewed from the side of the handle.
FIG. 2*c* shows a representation of a typical sliding door locking mechanism inside handle portion as viewed from the side of the handle.
FIG. 2*d* shows a representation of a typical sliding door locking mechanism inside handle portion as viewed from the back of the handle or from the outside of the door.

FIG. 2*a* shows a representation of a typical sliding door locking mechanism 101 outside handle portion as viewed from the back of the handle or from inside of the door. The mechanism center portion 115 slides up and down with operation from outside operation. The sliding portion is attached to a recess 117 by a suitable pin 119 or dowel to the mechanism 107 on the inside of the door as shown in FIGS. 2*c* and *d*.

FIG. 2*b* shows a representation of a typical sliding door locking mechanism 101 outside handle portion as viewed from the side of the handle. The outside center portion 115 of the mechanism slides up and down with operation from outside operation. The outside center portion 115 has a recess 123. The outside center portion 115 is attached when assembled to a door by the suitable pin 119 or dowel to the mechanism 107 on the inside of the door as shown in FIGS. 2*c* and *d*.

FIG. 2*c* shows a representation of a typical sliding door locking mechanism 107 inside handle portion as viewed from the side of the handle. An inside center portion 116 of the mechanism slides up and down with operation from inside operation. The sliding portion is attached by the suitable pin 119 or dowel to the mechanism on the outside of the door as shown in FIGS. 2*a* and *b*. A spring 121 attaches the inside sliding portion 116 to an arm screw 127 to cause the inside sliding portion 116 to stay in the up or latched position and to a mechanism 107 top mounting screw 129. The spring 121 has a critical spring total length (stretching from sliding portion mounting arm screw 127 to a mechanism mounting screw 129) and body length not to exceed length of the recess 123 as shown in FIG. 2*b*. Returning to FIG. 2*c* a remote control solenoid 128 is secured to mechanism 107 with mounting screws 129 and arm screw 127 to articulate inside center portion 116 remotely, The arm 125 is angled as shown to allow the arm to be depressed when the latch keeper (shown in FIGS. 3*c* and *f*) is encountered when sliding closed.

FIG. 2*d* shows a representation of a typical sliding door locking mechanism 107 inside handle portion as viewed from the back of the handle or from the outside of the door. The inside center portion 116 of the mechanism slides up and down with operation from inside operation. The inside center sliding portion 116 is attached by a suitable pin 119 or dowel to the mechanism on the outside of the door as shown in FIGS. 2*b* and *c*. The spring 121 attaches the inside center sliding portion 116 to the mounting screw 129 and arm screw 127 to cause the sliding portion to return to the up or latched position. The latching arm 125 is angled back as shown to allow the arm to be depressed when the latch keeper (shown in FIGS. 3*c* and *f*) is encountered when closing.

Figures 3A, 3B, 3C, 3D, 3E, 3F:
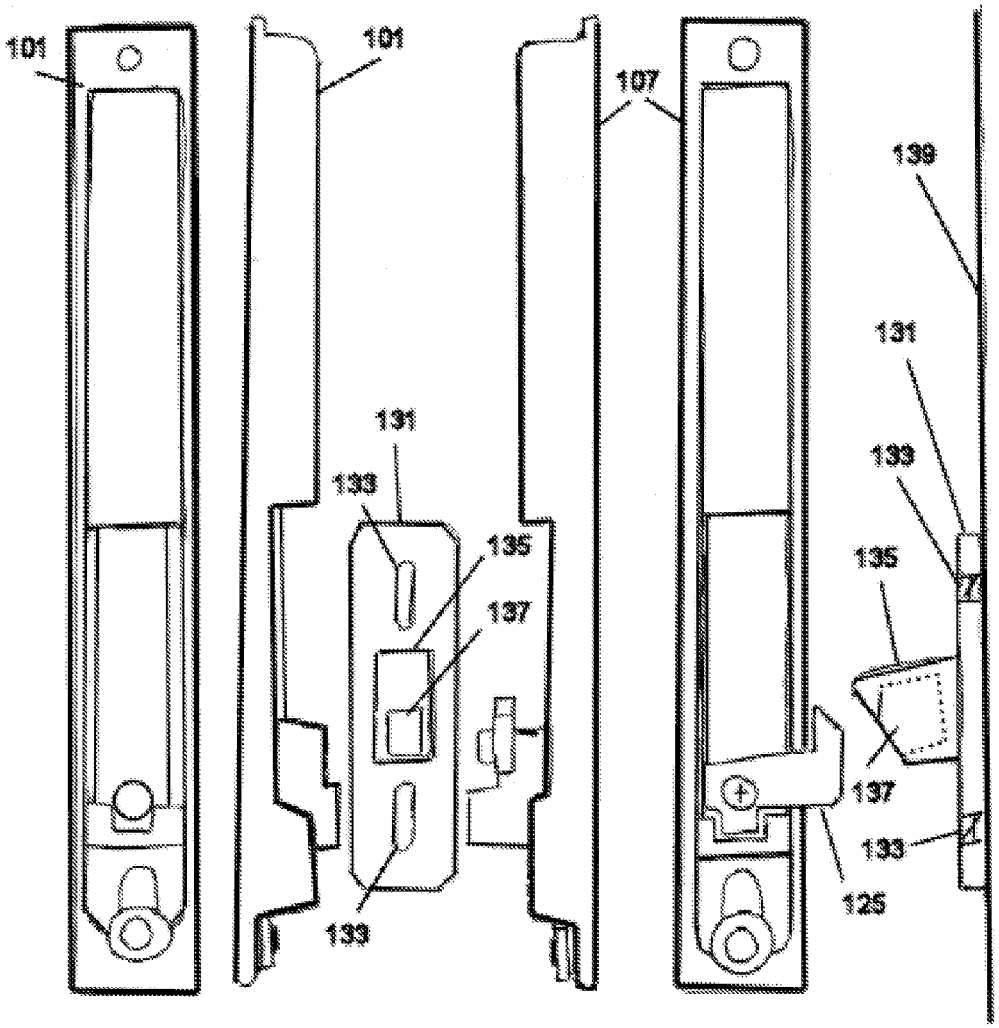
FIG. 3*a* shows a representation of a typical sliding door locking mechanism outside handle portion as viewed from the back of the handle or inside of the door.
FIG. 3*b* shows a representation of a typical sliding door locking mechanism outside handle portion as viewed from the side of the handle.
FIG. 3*c* shows a representation of a typical sliding door locking mechanism latch portion as viewed from the back of the center of the door.
FIG. 3*d* shows a representation of a typical sliding door locking mechanism inside handle portion as viewed from the side of the handle.
FIG. 3*e* shows a representation of a typical sliding door locking mechanism inside handle portion as viewed from the back of the handle or outside of the door.
FIG. 3*f* shows a representation of a typical sliding door locking mechanism striker of latching portion as viewed from outside of the door.

FIG. 3*a* shows a representation of a typical sliding door locking mechanism 101 outside handle portion as viewed from the back of the handle or inside of the door. The mechanism 101 is repeated from FIG. 2*a* to show perspective with a keeper latch 131 shown if FIG. 3*c*.

FIG. 3*b* shows a representation of a typical sliding door locking mechanism 101 outside handle portion as viewed from the side of the handle. The mechanism 101 is repeated from FIG. 2*b* to show perspective with the keeper latch shown in FIG. 3*c*.

FIG. 3*c* shows a representation of a typical sliding door locking mechanism with a keeper latch 131 as viewed from the back of the center of the door. The latch 131 is typically mounted to the sliding door mechanism or other suitable door jam stop. The latch 131 has two mounting screw holes 133 to facilitate physical mounting. The latch 131 has protrusion 135 with a recess 137 to capture latching arm 125 as shown in FIGS. 3*e* and 3*f*.

FIG. 3*d* shows a representation of a typical sliding door locking mechanism 107 inside handle portion as viewed from the side of the handle. The mechanism 107 is repeated from FIG. 2*c* to show positioning of keeper latch. The spring 121 is not shown to minimize clutter.

FIG. 3*e* shows a representation of a typical sliding door locking mechanism 107 inside handle portion as viewed from the back of the handle or outside of the door. The mechanism 107 is repeated from FIG. 2*d* to show positioning of keeper latch. The spring 121 is not shown to minimize clutter. The angled portion of the latch arm 125 will engage the keeper latch 135 through recess 137 as shown in FIGS. 3*c* and 3*f* when the door is fully slid closed.

FIG. 3*f* shows a representation of a typical mounted sliding door locking mechanism striker of keeper latch 131 mounted with screws in screw holes 133 to a door jam 139 as viewed from outside of the door. The protrusion 135 with recess 137 of the latch 131 is also angled to further assist in ease of latching arm 125 and keeper latch when the door is fully slid closed.

Operation

Installation of this sliding door safety latch hardware is typical of most any sliding door hardware.

1. Inside hardware is mounted in the manufacturer provided holes.
2. Outside hardware is mounted in the manufacturer provided holes.
3. Connection hardware a pin or dowel is employed to provide connection between the inside and outside sliding mechanisms.
4. Return hardware a suitable spring is connected to the door actuator arm and mounting screw as shown in FIGS. 2*c* and *d*. The tension and length of the spring should be sufficient to cause the latch arm to release enough to allow the arm to pass the keeper portion and engage when past the keeper nose. The spring body length should not exceed the length 123 shown in FIG. 2*b*. The latching arm 125 should be angled back as shown in FIG. 2*d*.
5. Keeper latch/striker hardware is mounted to the sliding door jam.
6. Normal operation is achieved when the door is fully slid closed the mechanism latch will engage the keeper latch. The door will remain closed only opening when the sliding mechanism is depressed from either the inside or outside.
7. Night/safety latch will operate as normal; when the night latch is engaged the door will not open from either side until the night latch is disengaged.
8. Key override can be installed to allow the night latch to be operated from the outside.

9. Auto closure is easily incorporated into operation for this mechanism.

10. Sensors for security monitoring or operation are simple to install for this mechanism.

What is claimed is:

1. A closure securing mechanism implementing a latching mechanism operating from inside or outside not requiring further operator intervention when doors for sliding doors are slid closed consisting of, an outside plate with an outside sliding portion that can be operated by an operator pushing on an outside handle on the outside sliding portion, an inside plate with an inside sliding portion that can be operated by an operator pushing on an inside handle on the inside sliding portion, a pin or dowel connects the inside and outside sliding portions so they track together, a latching arm attached to the inside sliding portion by an arm screw, an angled front edge on the latching arm facilitating engagement with a keeper latch having an angled nose to ease the operation of the mechanism, and a spring with sufficient tension and length, to fit between the outside and inside plates, to bias the inside sliding portion and secure the latching arm with the keeper latch, the spring has one end mounted on the arm screw and an opposed end mounted to a mechanism mounting screw.

2. The closure securing mechanism implementing an automatic latching mechanism for sliding doors of claim 1 wherein: the sliding door can be opened from inside or outside with standard pull handles with sliding locks.

3. The closure securing mechanism implementing an automatic latching mechanism for sliding doors of claim 1 wherein: the sliding plate portion has the spring of specific length in tension so whenever the door is slid closed and the keeper latch is engaged the hold latch will inhibit opening of the door until the tension of the spring is overcome by an operator sliding the sliding lock against the spring in tension.

4. The closure securing mechanism implementing an automatic latching mechanism for sliding doors of claim 1 wherein: the sliding plate can be operated from inside or outside.

5. The closure securing mechanism implementing an automatic latching mechanism for sliding doors of claim 1 wherein:

night/safety lock functions are fully compatible with this automatic latching mechanism.

6. The closure securing mechanism implementing an automatic latching mechanism for sliding doors of claim 1 wherein:

Key/locking functions to further secure positive locking are easily incorporated to this automatic latching mechanism.

7. The closure securing mechanism implementing an automatic latching mechanism for sliding doors of claim 1 wherein: a device attached between the mechanism and the arm screw facilitate remote control, sensors, solenoids, relays, closure devices or other operational enhancement equipment are to be included with this design.

8. A method of securing a sliding door when fully slid closed operating from inside or outside without any further interaction of the door operator comprising;

operating an outside plate with an outside a sliding portion by an operator pushing an outside handle on the outside sliding portion, operating an inside plate with an inside sliding portion by an operator pushing on an inside handle on the inside sliding portion, securing the inside and outside sliding portions by a pin or dowel so they track together, latching through an arm that is attached to the inside sliding portion by an arm screw, enabling latching by an angled front edge on the latching arm to facilitate engagement with a keeper latch, the keeper latch having an angled nose to ease operation of the mechanism, and providing a spring with sufficient tension to fit between the outside and inside plates, to bias the inside sliding portion and secure the latching arm with the keeper latch, the spring has one end mounted on the arm screw and an opposed end mounted to a mechanism mounting screw.

9. The method of securing a sliding door when fully slid closed without any further interaction of the door operator of claim 8 wherein: the sliding door can be opened from inside or outside with standard pull handles with sliding locks.

10. The method of securing a sliding door when fully slid closed without any further interaction of the door operator of claim 8 wherein: the sliding plate portion has the spring of specific length in tension so whenever the door is slid closed and the keeper latch is engaged the hold latch will inhibit opening of the door until the tension of the spring is overcome by an operator sliding the sliding lock against the spring in tension.

11. The method of securing a sliding door when fully slid closed without any further interaction of the door operator of claim 8 wherein: the sliding plate can be operated from inside or outside.

12. The method of securing a sliding door when fully slid closed without any further interaction of the door operator of claim 8 wherein: night/safety lock functions are fully compatible with this automatic latching mechanism.

13. The method of securing a sliding door when fully slid closed without any further interaction of the door operator of claim 8 wherein: Key/locking functions to further secure positive locking are easily incorporated to this automatic latching mechanism.

14. The method of securing a sliding door when fully slid closed without any further interaction of the door operator of claim 8 wherein: Remote control, sensors, solenoids, relays, closure devices or other operational enhancement equipment are to be included with this design through a device attached between the mechanism and the arm screw.

* * * * *